US010813435B2

(12) United States Patent
Kranes

(10) Patent No.: US 10,813,435 B2
(45) Date of Patent: Oct. 27, 2020

(54) DEVICE FOR TIGHTENING LOOSE NECK SKIN AND METHOD OF USING THE SAME

(71) Applicant: Janet Kranes, Westport, CT (US)

(72) Inventor: Janet Kranes, Westport, CT (US)

( * ) Notice: Subject to any disclaimer, the term of this patent is extended or adjusted under 35 U.S.C. 154(b) by 192 days.

(21) Appl. No.: 16/001,350

(22) Filed: Jun. 6, 2018

(65) Prior Publication Data

US 2019/0374008 A1 Dec. 12, 2019

(51) Int. Cl.
*A45D 44/22* (2006.01)

(52) U.S. Cl.
CPC ..... *A45D 44/22* (2013.01)

(58) Field of Classification Search
CPC ..... A61K 8/0212; A61Q 19/08; A61F 13/128; A61F 13/0203; A61F 13/0273; A61F 2/0063; A61B 17/085; A61B 2017/00592; A61B 2017/00654; A61B 17/0057; A61B 2017/0065; A61B 2017/00747; A45D 44/22
See application file for complete search history.

(56) References Cited

U.S. PATENT DOCUMENTS

| | | | | |
|---|---|---|---|---|
| 1,612,267 | A | 12/1926 | Earle et al. | |
| 2,573,791 | A | 11/1951 | Howells et al. | |
| 5,264,219 | A | 11/1993 | Godbey et al. | |
| 5,968,533 | A | 10/1999 | Porter et al. | |
| 6,897,348 | B2 | 5/2005 | Malik | |
| 7,114,495 | B2 * | 10/2006 | Lockwood, Jr. | A61F 5/08 128/200.24 |
| 8,342,173 | B2 * | 1/2013 | Lockwood, Jr. | A61F 5/08 128/200.24 |
| 9,314,312 | B2 | 4/2016 | Nazari | |
| 9,463,071 | B2 | 10/2016 | Nazari | |
| 9,565,887 | B2 | 2/2017 | Shapiro | |
| 9,585,427 | B2 | 3/2017 | Shapiro et al. | |
| 2006/0002987 | A1 | 1/2006 | Bevacqua et al. | |
| 2007/0269522 | A1 | 11/2007 | Wold | |
| 2008/0228217 | A1 * | 9/2008 | Friend | A45D 44/22 606/204.35 |

(Continued)

FOREIGN PATENT DOCUMENTS

| | | | |
|---|---|---|---|
| AU | 2012215115 | B2 | 8/2012 |
| CN | 105246455 | A | 1/2016 |

(Continued)

*Primary Examiner* — George J Ulsh
*Assistant Examiner* — Andrew P. Restaino
(74) *Attorney, Agent, or Firm* — Dunlap Bennett & Ludwig, PLLC

(57) ABSTRACT

A noninvasive method for tightening loose neck skin embodying a non-expensive, indiscrete external tensioning device is provided. The tensioning device is adapted to physically tension and tighten the loose neck skin. The tensioning device may be an elongated thin sheath defining a first surface and an opposing second surface. The first surface provides an adhesive portion that may be adhered to the back of a user's neck is such a manner so as to pull their frontal neck skin upward and backward for effectuating a noninvasive facelift thereof. Embedded between the first and second surfaces may be an integrated memory wire adaptable to move to a pinched condition providing additional tension force between the opposing ends of the tensioning device, and in turn to the neck skin.

9 Claims, 2 Drawing Sheets

(56) References Cited

U.S. PATENT DOCUMENTS

| | | | | |
|---|---|---|---|---|
| 2010/0236475 | A1 | 9/2010 | Bartusiak | |
| 2010/0282269 | A1 | 11/2010 | Uchida et al. | |
| 2012/0203192 | A1 | 8/2012 | Dennis et al. | |
| 2014/0031748 | A1 | 1/2014 | Usui | |
| 2014/0100599 | A1* | 4/2014 | Ha | A45D 44/22 606/201 |
| 2016/0367490 | A1 | 12/2016 | Binner et al. | |
| 2017/0112727 | A1 | 4/2017 | Boswell et al. | |

FOREIGN PATENT DOCUMENTS

| | | | |
|---|---|---|---|
| JP | 2017532336 | A | 11/2017 |
| WO | 03063817 | A | 8/2003 |
| WO | 2013000053 | A3 | 1/2013 |

* cited by examiner

DEVICE FOR TIGHTENING LOOSE NECK SKIN AND METHOD OF USING THE SAME

BACKGROUND OF THE INVENTION

The present invention relates to facelift procedures and, more particularly, to a noninvasive method for tightening loose neck skin embodying an external tensioning device.

Sagging redundant neck skin occurs gradually over time due to gravity and chronic changes in connective tissue generally associated with aging. Invasive surgical treatment to tighten such tissues is common, for example by facelift procedures. Surgery, however 'routine', is inherently fraught with risks. Furthermore, such cosmetic surgical procedures are expensive, yet do not guarantee good results and in any event still needs to be redone from time to time.

There are creams, lasers, and other non-invasive cosmetic procedures, but these approaches are indirect in nature, also fail to guarantee good results and still relatively expensive as well.

As can be seen, there is a need for a noninvasive method for tightening loose neck skin embodying a non-expensive, indiscrete external tensioning device adapted to physically tension and tighten the loose neck skin.

SUMMARY OF THE INVENTION

In one aspect of the present invention, neck skin tensioning device includes a sheath having a first surface and an opposing second surface; an adhesive portion disposed along the first surface; and a memory wire embedded between the first and second surfaces, wherein the memory wire is moveable between an original position and a pinched position biasing opposing portions of the sheath integrated with the memory wire in tension.

In another aspect of the present invention, the neck skin tensioning device includes a body having an elongated shape and generally uniform thickness of approximately one millimeter, the elongated shape defining a first surface and an opposing second surface; an adhesive portion disposed along the first surface; a memory wire embedded between the first and second surfaces, wherein the memory wire is moveable between an original position and a pinched position biasing opposing portions of the sheath integrated with the memory wire in tension, wherein the memory wire extends along a longitudinal axis of the sheath for a substantial length thereof; and a peel-away layer generally coextensive with and removably attached to the adhesive portion.

In yet another aspect of the present invention a method of providing a noninvasive facelift includes the steps of providing the above-mentioned neck skin tensioning device; backwardly and upwardly pulling redundant frontal neck skin on opposing sides of a jaw of a user; and adhering the adhesive portion to a nape of the neck so as to apply backwardly and upwardly tensional force to said redundant frontal neck skin on opposing sides.

These and other features, aspects and advantages of the present invention will become better understood with reference to the following drawings, description and claims.

DETAILED DESCRIPTION OF THE INVENTION

Figure 1:
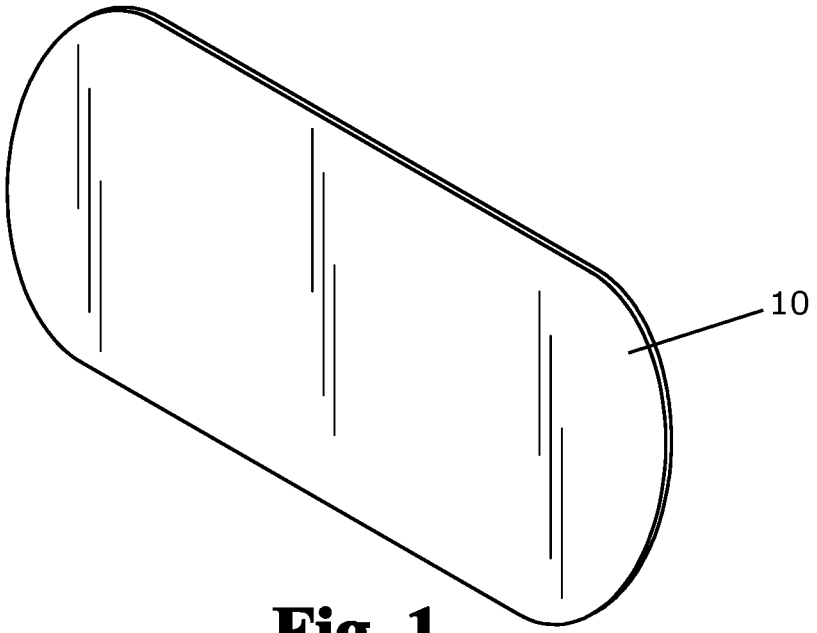
FIG. 1 is a front perspective view of an exemplary embodiment of the present invention.
Figure 2:
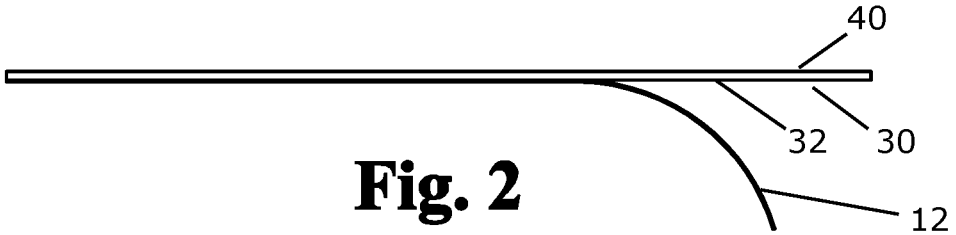
FIG. 2 is an edge view of an exemplary embodiment of the present invention, illustrating a peel-away layer in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a noninvasive method for tightening loose neck skin embodying a non-expensive, indiscrete external tensioning device adapted to physically tension and tighten the loose neck skin. The tensioning device may be an elongated thin sheath defining a first surface and an opposing second surface. The first surface provides an adhesive portion that may be adhered to the back of a user's neck is such a manner so as to pull their frontal neck skin upward and backward for effectuating a noninvasive facelift thereof. Embedded between the first and second surfaces may be an integrated memory wire adaptable to move to a pinched condition providing additional tension force between the opposing ends of the tensioning device, and in turn to the neck skin.

Referring to FIGS. 1 through 5, the present invention may include a noninvasive method for tightening loose neck skin embodying a non-expensive, indiscrete external tensioning device 10 adapted to physically tension and tighten the loose neck skin 20.

The tensioning device 10 may be a sheath of soft latex, breathable plasticized material, or the like. The tensioning device 10 may be any shape so long as it functions in accordance with the present invention as described herein. Thus, the tensioning device 10 may be other shapes beside oval, as shown in the Figures, including but not limited to rectangular, circular, square, triangular, and the like. Generally, the tensioning device 10 may be approximately six inches long and two and a half inches in width, in certain embodiments. The tensioning device 10 may have a thickness of approximately one millimeter, meaning the thickness may be 0.5 to 2.0 millimeters.

The tensioning device 10 may provide a first surface 30 and an opposing second surface 40 defined by the shape. The first surface 30 may be adhesive in nature. A non-adhesive peel-away layer 12 may be coextensive with the first surface 30, or at least the adhesive portion 32 thereof, so that a user 50 may peel away the peel-away layer 12 exposing the adhesive portion 32, whereby the user 50 may operatively adhere the tensioning device 10 to their skin.

Figure 3:
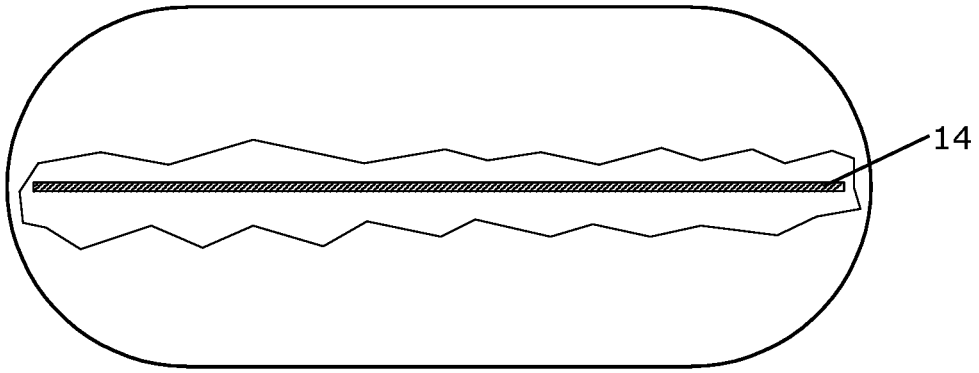
FIG. 3 is a side cutaway view of an exemplary embodiment of the present invention, illustrating an internal memory wire.

The tensioning device 10 may be have a memory wire 14 embedded between and integrated with the first and second surfaces 30 and 40, as illustrated in the cut-away view of FIG. 3. The memory wire 14 may have material properties so that if the user 50 "pinches" the memory wire 14 with their fingers, or the like—similar to an individually pinching a fold of skin—the memory wire 14 is self-urged to maintain the resulting "pinched" position, thereby increasing the tension through the connected tensioning device 10. The memory wire 14 may extend along a longitudinal axis of the sheath/body/tensioning device 10 for a substantial length thereof—e.g., at least one half of the longitudinal length of the sheath.

In the pinched position, the end-to-end length of the memory wire 20 is shorten, biasing the respective opposing portions the tensioning device 10 in tension, pulling these opposing portions toward each other. The user 50 may manually move the memory wire 14 back to its "longer" original un-pinched position, as illustrated in FIG. 3.

Figure 4:
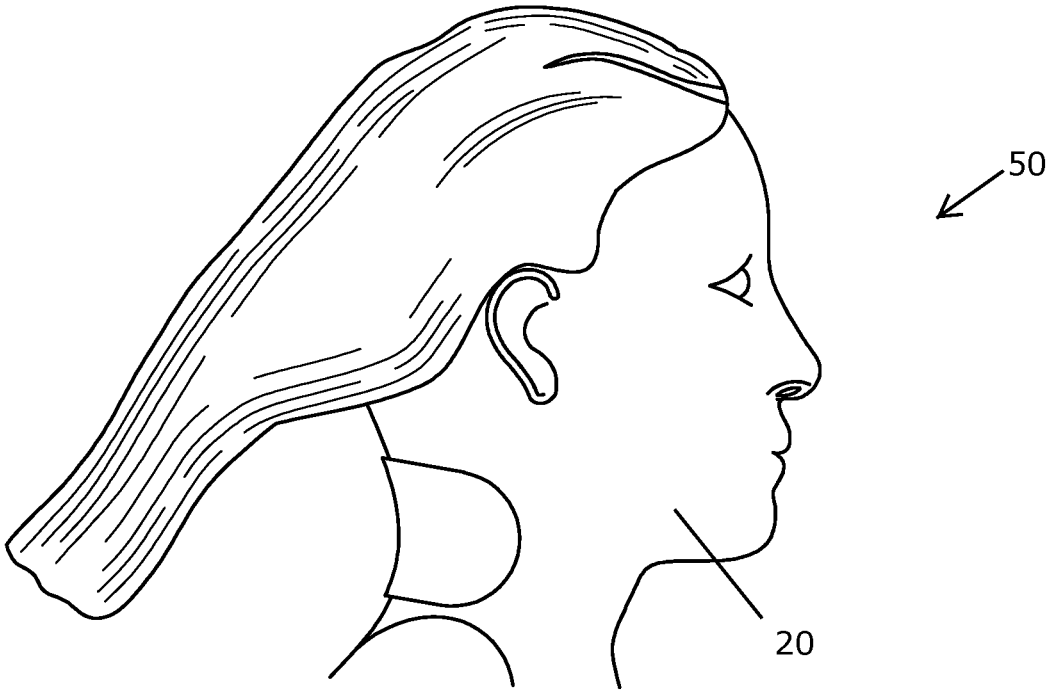
FIG. 4 is a perspective view of an exemplary embodiment of the present invention, shown in use.
Figure 5:
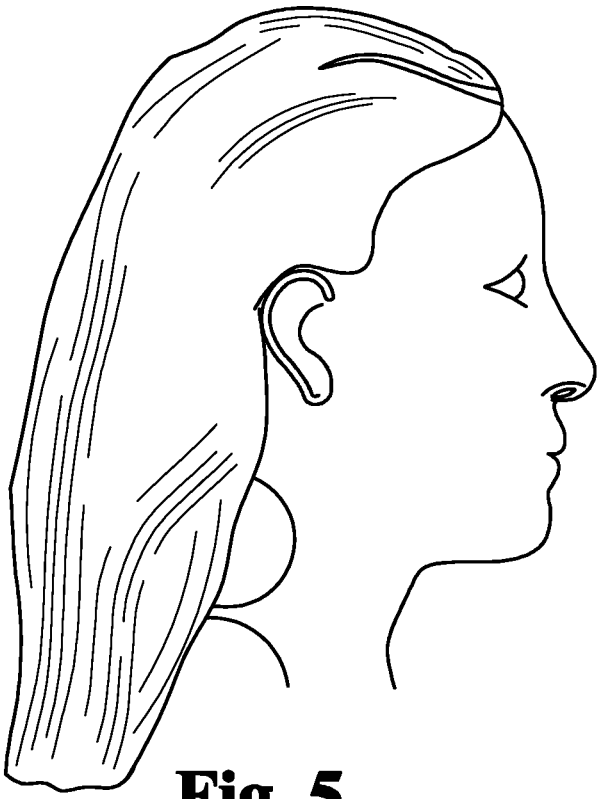
FIG. 5 is a perspective view of an exemplary embodiment of the present invention, shown in use demonstrating the present invention's indiscrete nature.

A method of using the present invention may include the following. The tensioning device 10 disclosed above may be provided. A user 50 interested in avoiding cosmetic surgery or other non-proven indirect solutions to saggy, redundant frontal neck skin 20 may peel away the peel-away layer 12, exposing the adhesive portion 32 of the first surface 30. Then the user may apply the adhesive portion 32 to the back of the neck; at, near or adjacent to the nape of the neck under their hairline, as illustrated in FIGS. 4 and 5. Typically, the back of the neck where the tensioning device 10 is applied is anatomically backward (posterior) and upward of the redundant frontal neck skin 20 in question. The tensioning device 10 is adhere to the back of the neck so as to pull the redundant frontal neck skin backwards and upwards toward the back of the neck, resulting in a tightened "facelift", smoothing of the frontal neck skin 20. Thus, in certain, methods the user 50 may first pull their frontal neck skin 20 backward and upward as they adhere the adhesive portion 32 so that the tensioning device 10 maintains this pulled, tensioned configuration of the frontal neck skin 20.

For additional tensive force applied through the tensioning device 10, the user 50 may selectively move the memory wire 14 to one of many pinched positions, as described above.

Then, if the user 50 has longer hair along their neck, they can let it down to discretely cover the applied tensioning device 10, as illustrated in FIG. 5.

The present invention is adapted to be removed and disposed of daily, and a new tensioning device 10 utilized when desired by the user 50.

It should be understood, of course, that the foregoing relates to exemplary embodiments of the invention and that modifications may be made without departing from the spirit and scope of the invention as set forth in the following claims.

What is claimed is:

1. A neck skin tensioning device, comprising:

a sheath having a first surface and an opposing second surface;

an adhesive portion disposed along the first surface; and a memory wire embedded between the first and second surfaces, wherein the memory wire is moveable between an original position and a pinched position biasing opposing portions of the sheath integrated with the memory wire in directions, respectively, toward each other.

2. The neck skin tensioning device of claim 1, further comprising a peel-away layer generally coextensive with and removably attached to the adhesive portion.

3. The neck skin tensioning device of claim 1, wherein the sheath is elongated in shape and has a generally uniform thickness of approximately one millimeter.

4. The neck skin tensioning device of claim 3, wherein the memory wire extends along a longitudinal axis of the sheath for a substantial length thereof.

5. A neck skin tensioning device, comprising:

a body having an elongated shape and generally uniform thickness of approximately one millimeter, the elongated shape defining a first surface and an opposing second surface;

an adhesive portion disposed along the first surface;

a memory wire embedded between the first and second surfaces, wherein the memory wire is moveable between an original position and a pinched position biasing opposing portions of the sheath integrated with the memory wire in directions, respectively, toward each other, wherein the memory wire extends along a longitudinal axis of the sheath for a substantial length thereof; and a peel-away layer generally coextensive with and removably attached to the adhesive portion.

6. A method of providing a noninvasive facelift, comprising the steps of:

providing the neck skin tensioning device of claim 1;

backwardly and upwardly pulling redundant frontal neck skin on opposing sides of a jaw of a user; and adhering the adhesive portion to a nape of the neck so as to apply backwardly and upwardly tensional force to said redundant frontal neck skin on opposing sides.

7. The method of claim 6, further comprising the step of initially pinching the memory wire to a selective pinching position prior to adhering the adhesive portion.

8. A method of providing a noninvasive facelift, comprising the steps of:

providing the neck skin tensioning device of claim 5;

removing the peel-away layer;

backwardly and upwardly pulling redundant frontal neck skin on opposing sides of a jaw of a user; and adhering the adhesive portion to a nape of the neck so as to apply backwardly and upwardly tensional force to said redundant frontal neck skin on opposing sides.

9. The method of claim 8, further comprising the step of initially pinching the memory wire to a selective pinching position prior to adhering the adhesive portion.

* * * * *